US010640335B2

(12) United States Patent
Donahue et al.

(10) Patent No.: US 10,640,335 B2
(45) Date of Patent: May 5, 2020

(54) CANTILEVERED CRANE SYSTEM FOR A FACTORY WORK STATION

(71) Applicants: Konecranes Global Corporation, Hyvinkää (FI); GM Global Technology Operations LLC, Detroit, MI (US)

(72) Inventors: Chad Donahue, Chesterfield, MI (US); Derrick Torrey, White Lake, MI (US)

(73) Assignees: Konecranes Global Corporation, Hyvinkää (FI); GM Global Technology Operations LLC, Detroit, MI (US)

( * ) Notice: Subject to any disclaimer, the term of this patent is extended or adjusted under 35 U.S.C. 154(b) by 51 days.

(21) Appl. No.: 15/673,531

(22) Filed: Aug. 10, 2017

(65) Prior Publication Data

US 2018/0044146 A1 Feb. 15, 2018

Related U.S. Application Data

(60) Provisional application No. 62/374,189, filed on Aug. 12, 2016.

(51) Int. Cl.

| | |
|---|---|
| ***B66C 17/00*** | (2006.01) |
| ***B66C 19/00*** | (2006.01) |
| ***B66C 7/04*** | (2006.01) |
| ***B66C 5/02*** | (2006.01) |
| ***B66C 13/00*** | (2006.01) |

(52) U.S. Cl.

CPC ..... *B66C 17/00* (2013.01); *B66C 5/02* (2013.01); *B66C 7/04* (2013.01); *B66C 13/00* (2013.01); *B66C 19/00* (2013.01)

(58) Field of Classification Search

CPC ..... B66C 17/00; B66C 13/00; B66C 5/02; B66C 7/04; B66C 7/02; B66C 19/00

See application file for complete search history.

(56) References Cited

U.S. PATENT DOCUMENTS 164,643 A * 6/1875 Force, Jr. ..... B66C 13/00 212/327
945,751 A * 1/1910 Butler ..... B61B 13/04 104/95
1,515,023 A * 11/1924 Fitch ..... B66C 19/002 104/126

(Continued)

FOREIGN PATENT DOCUMENTS

DE 3824907 * 1/1990

OTHER PUBLICATIONS

Inventor Statement regarding activities occurring prior to Aug. 12, 2015.

*Primary Examiner* — Michael E Gallion

(74) *Attorney, Agent, or Firm* — Gardner, Linn, Burkhart & Ondersma LLP

(57) ABSTRACT

A workstation having a cantilevered crane system that includes one or more cantilevered header assemblies, with each cantilevered header assembly including an upright column and a horizontally oriented header, with the header extending from the column with a free end distal from the column. The headers support a pair of runway rails, with at least one bridge rail movably mounted to the runway rails and supporting a moveable hoist. The cantilevered crane system defines a workstation area bounded by the columns and headers, with the workstation area including an open side adjacent the free ends of the headers.

19 Claims, 12 Drawing Sheets

(56) References Cited

U.S. PATENT DOCUMENTS 1,858,183 A * 5/1932 Bridges ..... B66C 1/24 294/63.1
2,164,128 A * 6/1939 Medenwald ..... B66C 13/06 182/36
3,051,322 A * 8/1962 Bellinger ..... B66C 17/00 212/291
3,074,562 A * 1/1963 Clayborne ..... E01B 29/16 212/327
3,402,824 A * 9/1968 Zweifel ..... B66C 1/101 212/170
3,770,137 A * 11/1973 Slutsky ..... B66C 17/00 212/224
3,783,792 A * 1/1974 Cullom ..... B66C 17/00 104/128
4,202,529 A * 5/1980 Fitting ..... B66F 7/16 254/89 H
4,243,147 A * 1/1981 Twitchell ..... B66C 17/00 212/284
4,890,750 A * 1/1990 Stern ..... B66C 9/16 105/163.2
4,930,970 A * 6/1990 Sunderland ..... B60P 1/5442 212/227
4,944,056 A * 7/1990 Schroeder ..... A61G 7/1015 5/85.1
5,074,528 A * 12/1991 Long, Jr. ..... B66C 19/00 254/285
5,337,908 A * 8/1994 Beck, Jr. ..... A61G 7/1015 104/126
5,653,351 A * 8/1997 Grout ..... B66C 19/005 212/315
5,743,702 A * 4/1998 Gunderson ..... B60P 1/5442 224/403
5,788,096 A * 8/1998 Wilcox ..... B66C 5/02 212/312
5,809,591 A * 9/1998 Capaldi ..... A61G 7/1015 5/83.1
5,862,926 A * 1/1999 Johnson ..... B60P 1/5442 212/180
6,666,643 B1 * 12/2003 Heynssens ..... B60P 1/4435 212/180
7,011,486 B2 * 3/2006 Dyer ..... B60P 1/54 212/180
7,048,491 B2 * 5/2006 Windbergs ..... B66C 9/08 212/312
7,134,831 B2 * 11/2006 Risser ..... B60P 1/5442 414/542
H2178 H * 2/2007 Rivera ..... 212/316
D577,875 S * 9/2008 Dorsett ..... D34/31
8,534,980 B2 * 9/2013 Kuramoto ..... B60P 1/5409 212/180
8,584,274 B2 * 11/2013 Hushek ..... A61G 7/1019 5/601
8,960,459 B2 * 2/2015 Givens ..... B66C 5/02 212/73
9,067,765 B2 * 6/2015 Spies ..... B66C 7/02
9,085,308 B2 * 7/2015 Laliberte ..... B61H 5/00
9,751,730 B2 * 9/2017 Paßmann ..... B66C 19/00
9,909,713 B1 * 3/2018 Brockie ..... F16M 13/022
10,421,645 B2 * 9/2019 Givens ..... B66C 7/04
2001/0040233 A1 * 11/2001 Chamberlain ..... B25H 1/0014 254/4 R
2002/0084238 A1 * 7/2002 Zingerman ..... B66C 23/22 212/179
2008/0264889 A1 * 10/2008 Larsen ..... B66C 19/002 212/316
2012/0005980 A1 * 1/2012 Kundel, Sr. ..... B66C 7/08 52/651.05

* cited by examiner

CANTILEVERED CRANE SYSTEM FOR A FACTORY WORK STATION

CROSS REFERENCE TO RELATED APPLICATION

The present application claims priority of U.S. provisional application Ser. No. 62/374,189 filed Aug. 12, 2016, which is hereby incorporated herein by reference in its entirety.

BACKGROUND OF THE INVENTION

The present invention is directed to an overhead cantilevered crane system for use in a facility to provide an open sided work station.

Overhead cranes are used in various types of facilities, such as manufacturing environments, for the movement of inventory, tools, equipment and work in progress components that are being manufactured. Known overhead cranes are configured to include pairs of posts or columns that are secured into a floor surface, with beams affixed to and between the posts and along which a crane trolley system may be moved for assisting the lifting and lowering of items in the area of the overhead crane.

SUMMARY OF THE INVENTION

The present invention provides a cantilevered crane system for a building to define a work station having an open side opposite columns of the crane system.

According to an aspect of the present invention, a cantilevered crane system comprises a plurality of cantilevered header assemblies, with each cantilevered header assembly including an upright column and a horizontally oriented header, wherein the header extends from the column with a free end distal from the column. Each header supports a pair of runway rails, with at least one bridge rail movably mounted to the runway rails. The cantilevered crane system defines a workstation area bounded by the columns and the headers, with the workstation area including an open side adjacent the free ends of the headers.

The cantilevered crane system provides a work station for a factory or warehouse having multiple open sides to advantageously enable the delivery into and/or removal of parts, products or material into the work station, such as by way of fork lifts or other such means.

These and other objects, advantages, purposes and features of this invention will become apparent upon review of the following specification in conjunction with the drawings.

DESCRIPTION OF THE PREFERRED EMBODIMENTS

Figure 1:
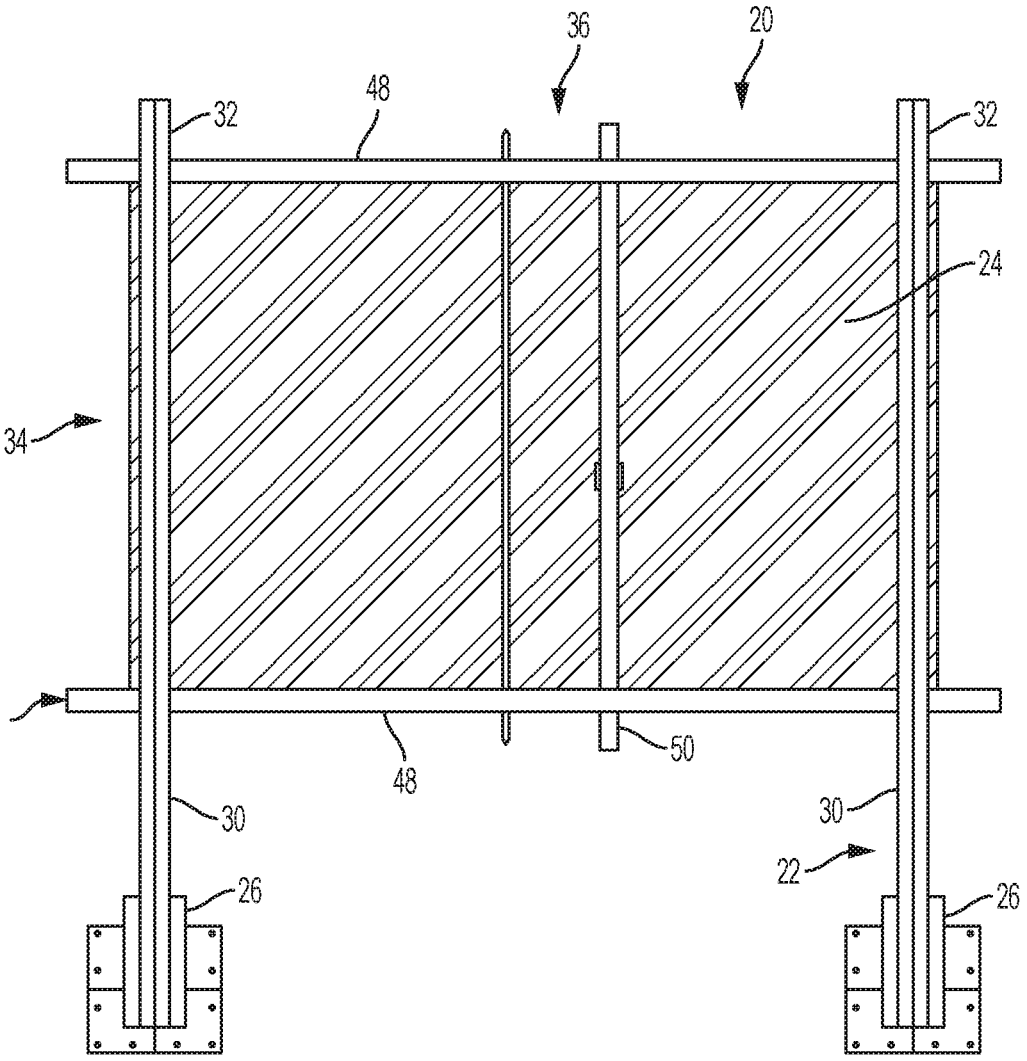
FIG. 1 is an overhead top plan view of a factory work station with a cantilevered crane system in accordance with aspects of the present invention.
Figure 2:
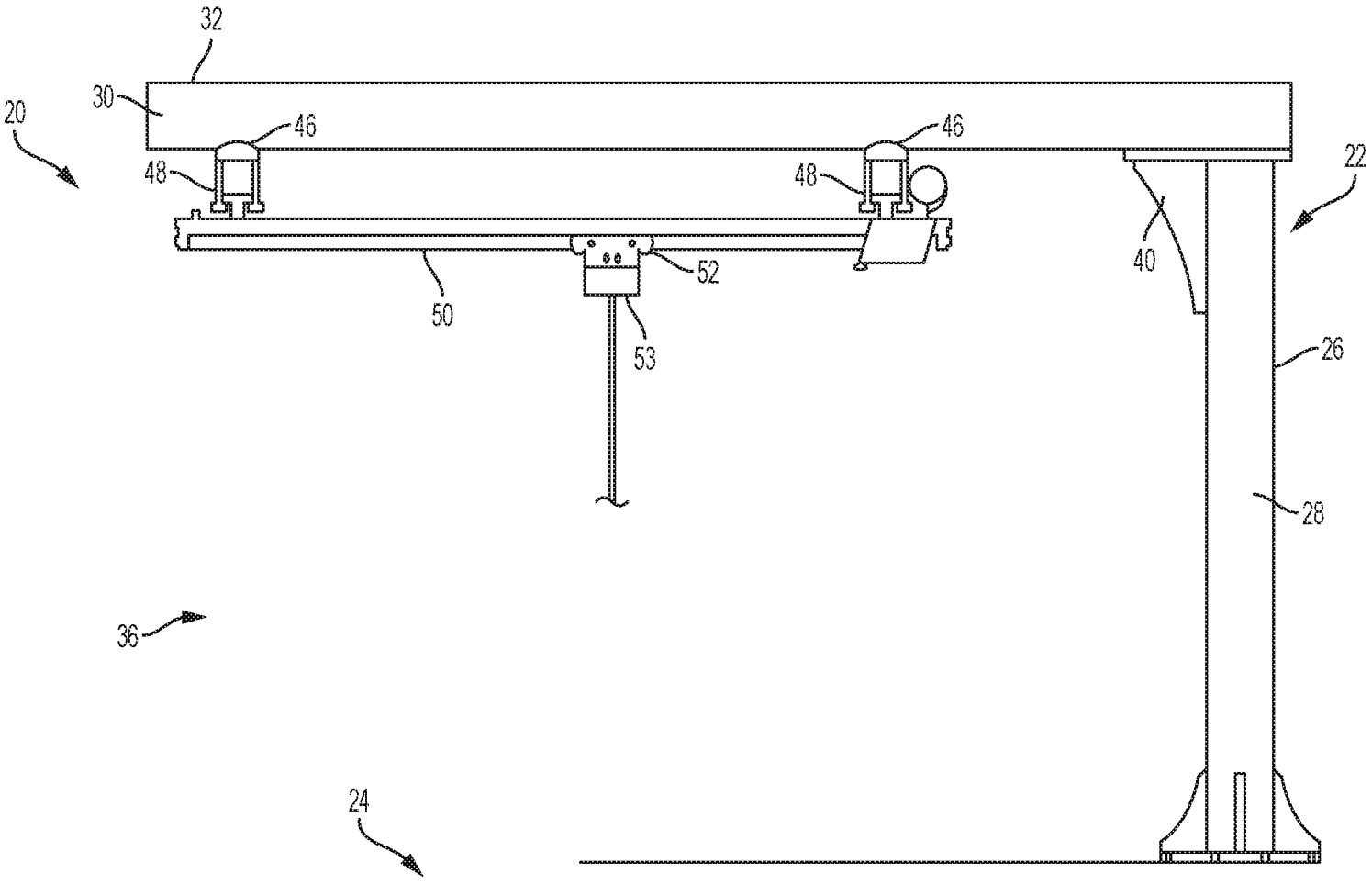
FIG. 2 is a side elevation view of the work station and cantilevered crane system of FIG. 1.
Figure 3:
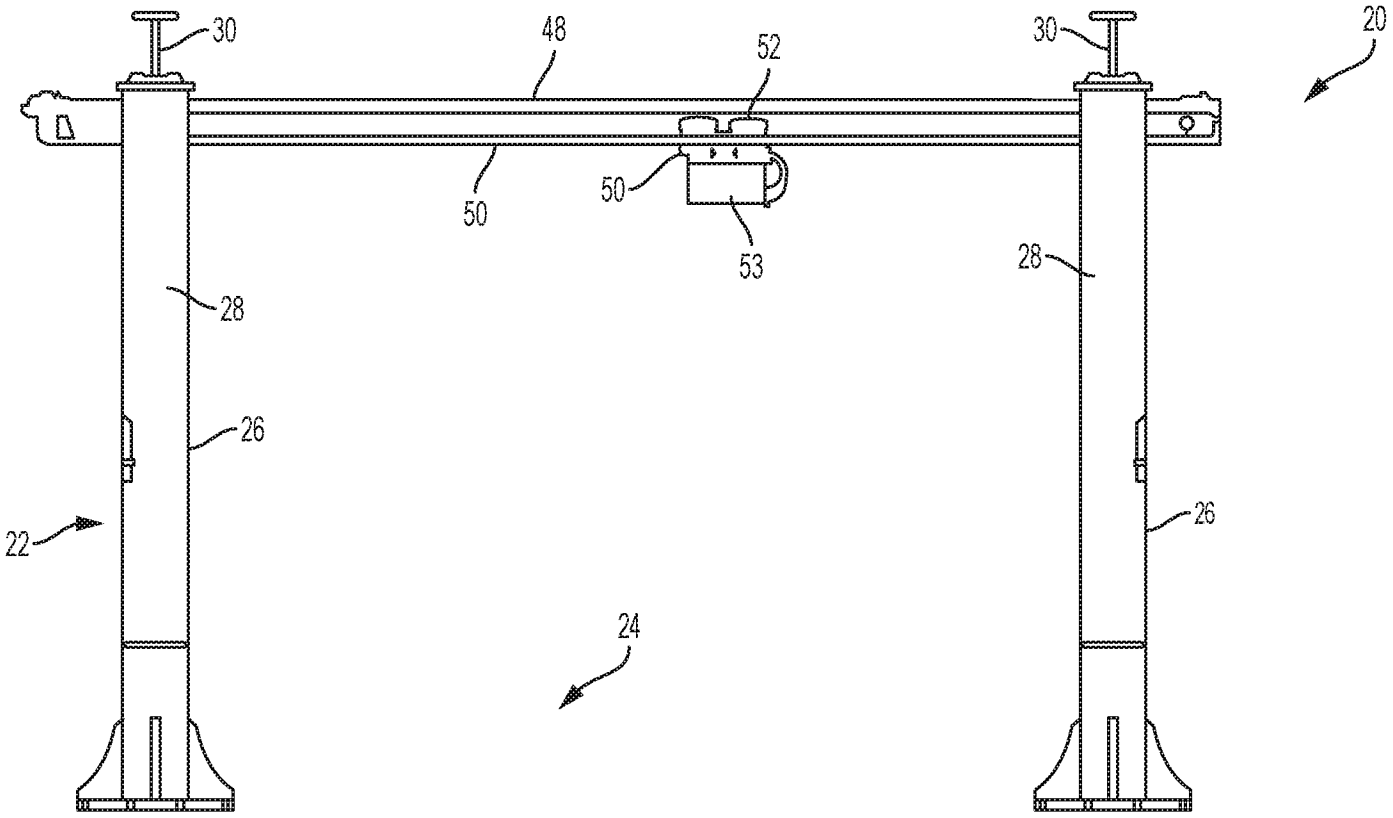
FIG. 3 a rear elevation view of the work station and cantilevered crane system of FIG. 1.

The present invention will now be described with reference to the accompanying figures, wherein the numbered elements in the following written description correspond to like-numbered elements in the figures. A work station 20 is shown in FIGS. 1-3 to include a cantilevered crane system 22. The work station 20 defines an area 24 on a floor surface, such as a cement floor in a building. The crane system 22 includes a pair of cantilevered header assemblies 26 that comprise an upright column or post 28 and a horizontally oriented header 30, where the header 30 is supported in a cantilever fashion to have an end 32 that is freely supported above the floor surface. Work station 20 thus includes three sides 34, 36 and 38 that are free from columns or posts to advantageously enable the delivery into and/or removal of parts, products or material into work station 20, such as by way of a fork lift or other such means.

Figure 4:
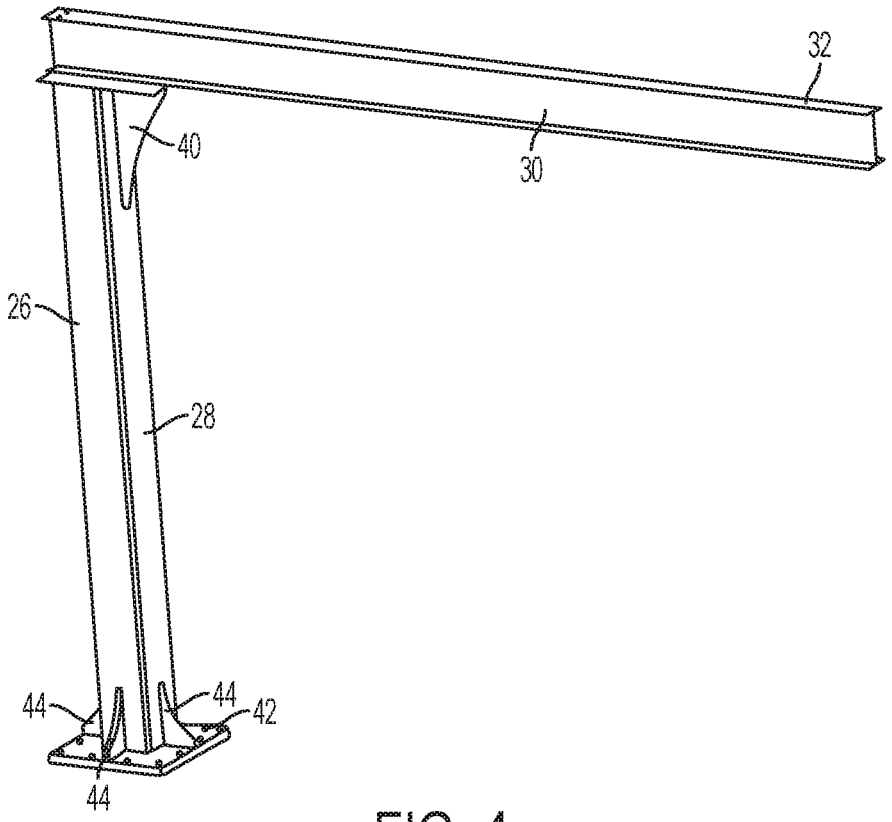
FIG. 4 is a perspective view of a cantilevered header assembly of the cantilevered crane system of FIG. 1 shown removed from the crane system.
Figure 8A:
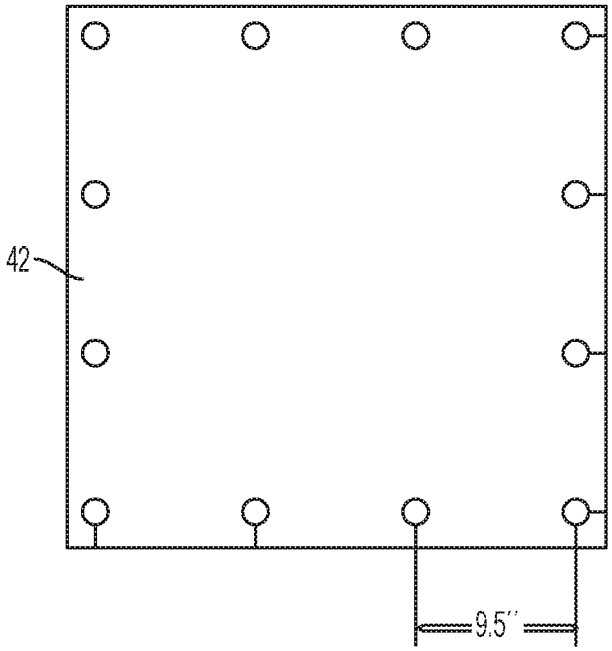
FIG. 8A is a top plan view of a support plate assembly for a cantilevered header assembly in accordance with an aspect of the present invention.
Figure 8B:
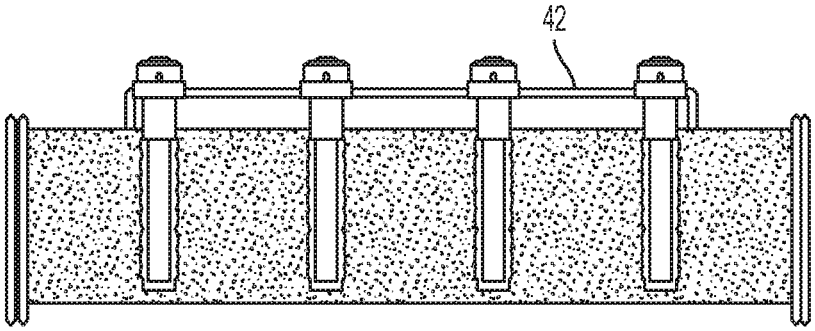
FIG. 8B is a side elevation view of the support plate assembly of FIG. 8A shown mounted to a support surface.

A cantilevered header assembly 26 is additionally shown in FIG. 4 removed from crane system 22. In the illustrated embodiment header 30 comprises a steel I beam and columns 28 comprise square tubes made of steel. A bracket or flange 40 is disposed at the connection of header 30 to column 28, with column 28 being affixed to a mounting plate 42 for securing the assembly 26 to the floor surface, where mounting plate 42 may be secured to the floor via a plurality of fasteners (see FIGS. 8A and 8B). A plurality of brackets or flanges 44 are disposed about the lower connection of column 28 with mounting plate 42.

Referring again to FIGS. 1-3, in addition to columns 28 and headers 30, crane system 22 further includes hangar brackets 46 that are secured to headers 30 and are used to support runway rails 48 that span between headers 30 of the two cantilevered header assemblies 26. As understood from FIGS. 1 and 2, crane system 22 includes a pair of rails 48 that are disposed along the length of headers 30, with one positioned nearer to columns 28 and the other rail 48 disposed nearer to the ends 32 of headers 30. Still further, a bridge or bridge rail 50 is movably supported between runway rails 48, with bridge 50 including a moveable hoist that includes a trolley 52 that slides axially along bridge 50 with trolley 52 supporting a hoist 53, such as a chain hoist or air host. It should be appreciated that multiple bridge rails with moveable hoists may be movably supported on runway rails 48, or that a moveable hoist may be supported by more than one bridge rail.

In operation, crane system 22 is thus able to transport or move parts, containers, or the like about area 24 of work station 20 while readily enabling access to work station 20 via sides 34, 36 and 38. In the illustrated embodiment, headers 30 extend from columns approximately 20 feet, and are supported approximately 14 feet above the floor surface.

Figure 5:
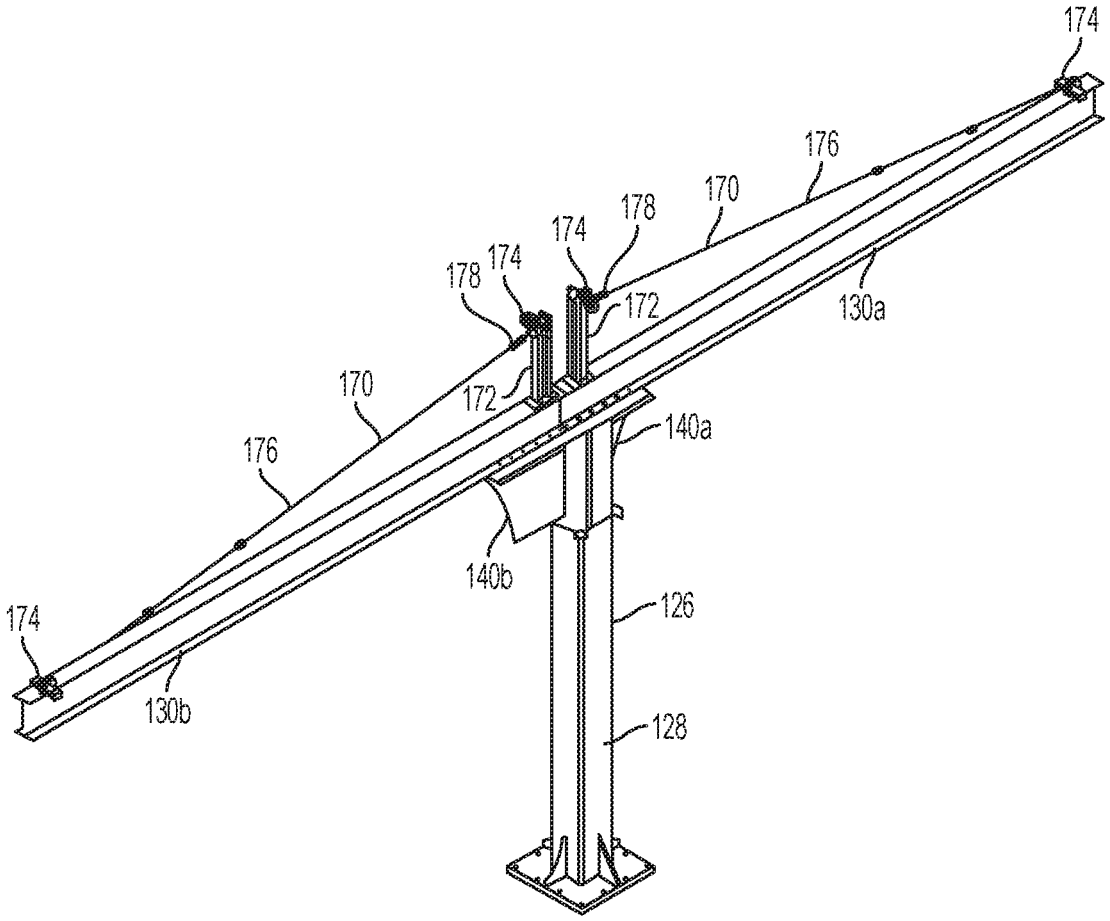
FIG. 5 is a perspective view of an alternative cantilevered header assembly in accordance with aspects of the present invention.
Figure 6:
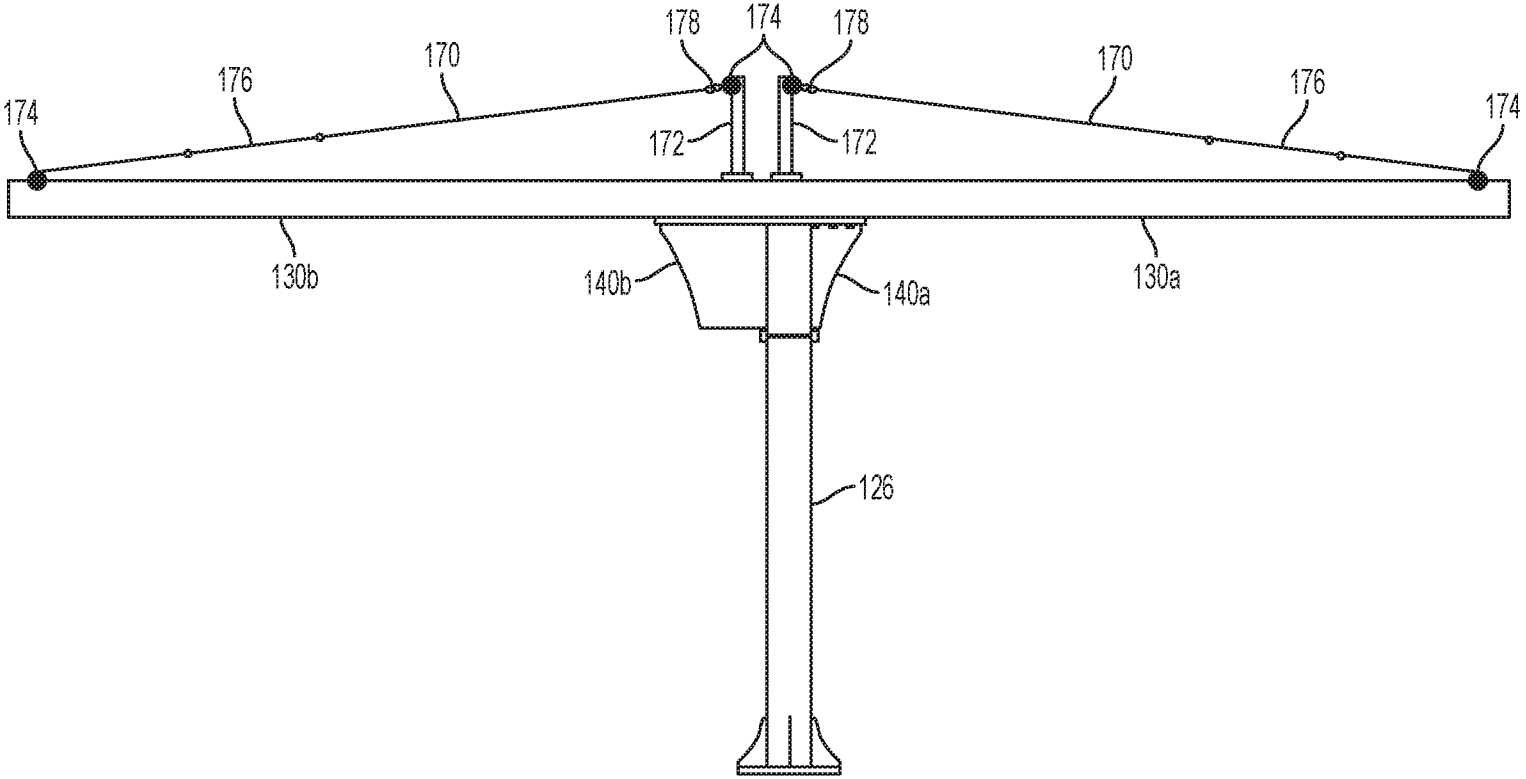
FIG. 6 is a side elevation view of the cantilevered header assembly of FIG. 5.
Figure 7:
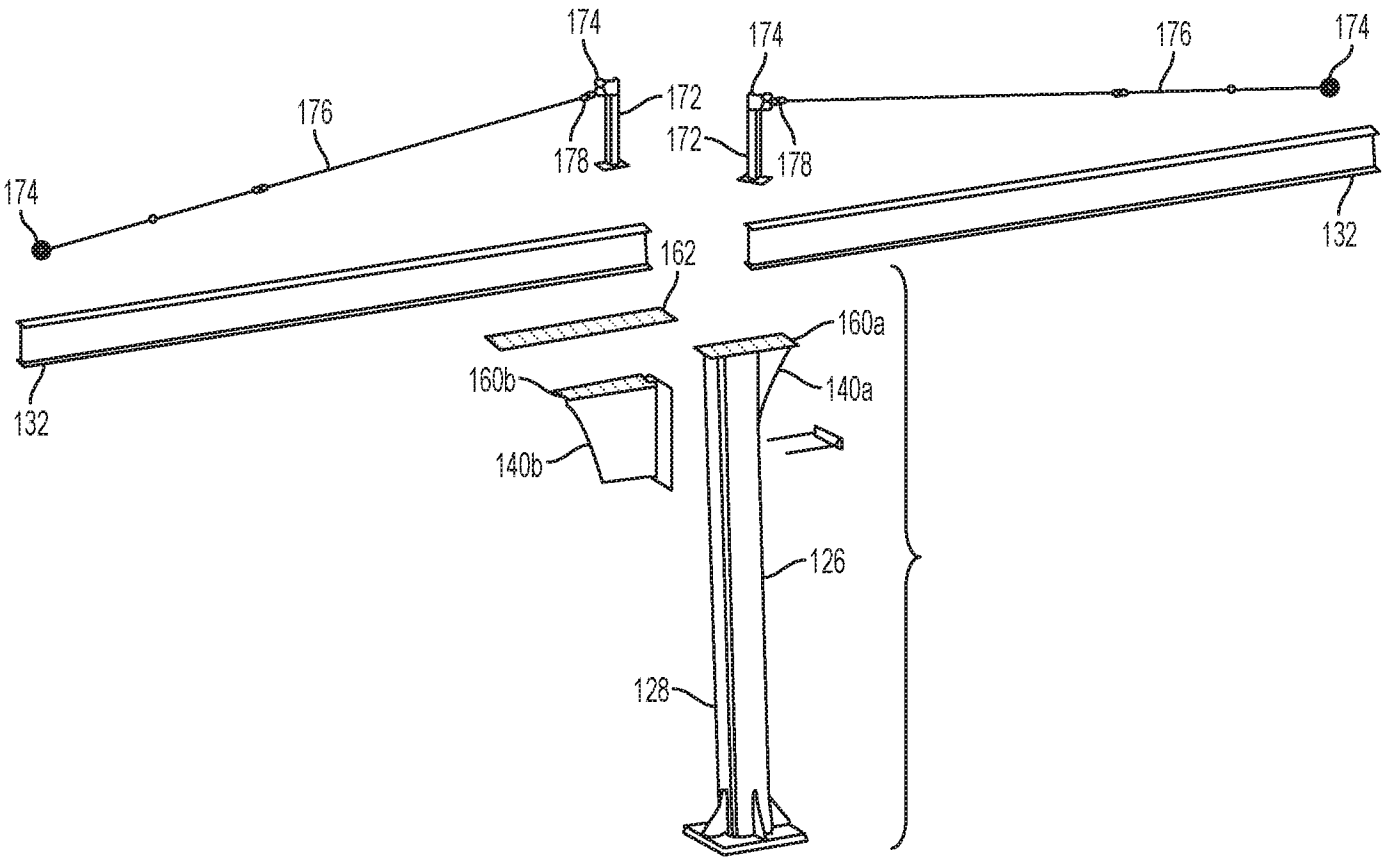
FIG. 7 is an exploded perspective view of the cantilevered header assembly of FIG. 5.

Referring now to FIGS. 5-7, an alternative cantilevered header assembly 126 is illustrated that includes a pair of headers 130*a*, 130*b* extending outwardly from column 128 to form a generally T-shaped configuration. Cantilevered header assembly 126 is used to provide crane systems to work stations located on either side of column 128, where such a work station may employ one or more of header assemblies 126 and header assemblies 26.

Cantilevered header assembly 126 is shown to include a first bracket 140*a* that is used in the connection of header 130*a* to column 128. A second bracket 140*b* is included that is used in the connection of header 130*b* to column 128. As shown, each of brackets 140*a* and 140*b* include an upper plate portion 160*a*, 160*b*, respectively. An additional mounting plate 162 is provided that spans the upper plate portions 160*a*, 160*b*, with fasteners being used to secure the headers 130*a*, 130*b* through mounting plate 162 to brackets 140*a*, 140*b*.

In the illustrated embodiment each of headers 130*a*, 130*b* optionally includes a support or vibration dampening assembly 170, which aids in supporting and inhibiting the effects of harmonic vibrations from movement of bridges or bridge rails along runway rails, and the like. The dampening assemblies 170 include upright or vertically oriented members 172 extending from the upper surface of the headers 130*a*, 130*b*. Each assembly further includes a pair of brackets 174, with one mounted to the upright member 172 and the other mounted near the end 132 of each of the headers 130*a*, 130*b*. In the illustrated embodiment brackets 174 comprise hangar brackets, such as hangar brackets 46 noted above. A tension support member is disposed between the brackets 174, where in the illustrated embodiment the tensions support member comprises a threaded rod 176. Tensioners are joined with the tension support members, where in the illustrated embodiment the tensioners comprise turnbuckles 178 connected at one of the brackets 174 to control the tension on the threaded rods 176. It should be appreciated that alternative configurations may be employed, including unthreaded rods or cables in place of rods or the like. Although shown in connection with a T-shaped cantilevered header assembly 126, it should also be appreciated that a support or dampening assembly may be used with a system having a single cantilevered header of the format shown in FIG. 4, in which case an upright member is provided with a rod extending therefrom toward the free end of the cantilevered header.

Figure 9:
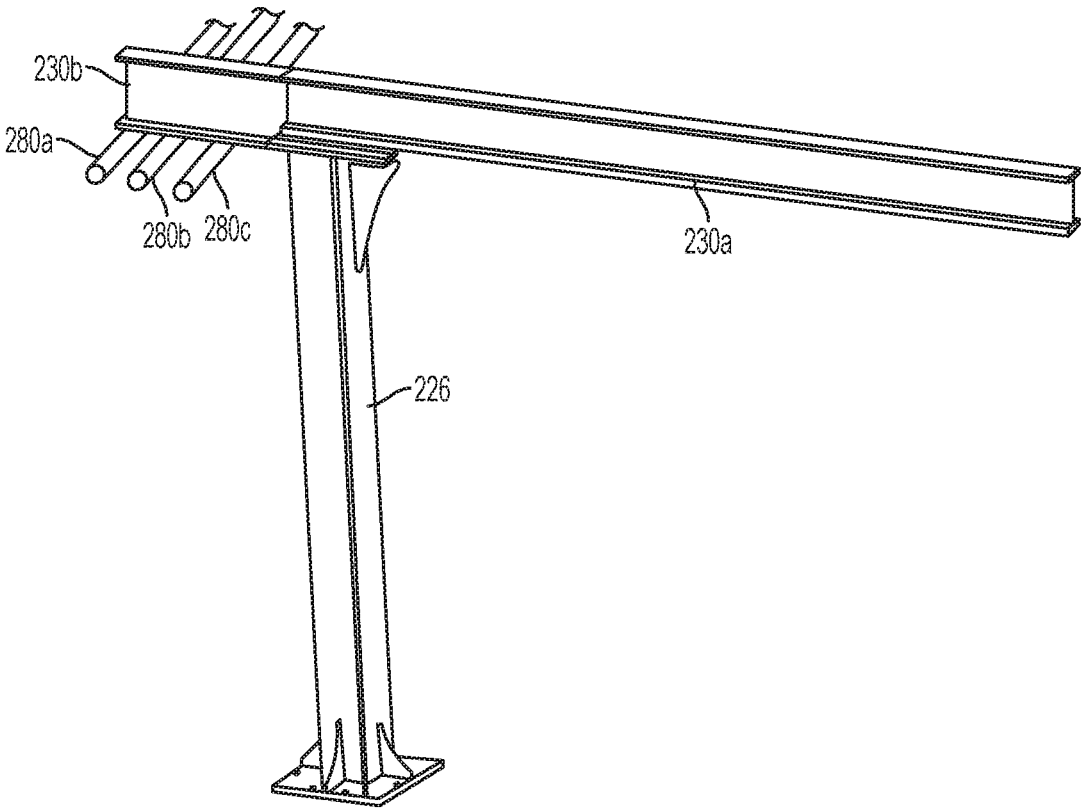
FIG. 9 is a perspective view of an alternative cantilevered header assembly for a cantilevered crane system in accordance with another aspect of the present invention.

FIG. 9 illustrates another alternative generally T-shaped cantilevered header assembly 226 having a pair of headers 230*a*, 230*b*. As shown, header 230*b* is shorter in length than header 230*a*. Instead of supporting crane components, header 230*b* is configured to support plant services components thereon, such as water lines 280*a*, electrical conduits 280*b*, compressed air lines 280*c*, and the like. Header assemblies 226 may thus be used in the formation of a modular work station that is fully supported with utilities for operating equipment within the workstation, as well as be used to support the plant services for supplying to other work stations and/or areas of the building.

Although work station 20 is shown to include a cantilevered crane system 22 having just two cantilevered header assemblies 26, it should be appreciated that alternative work stations may be configured in accordance with the scope of the present invention. For example, more than two header assemblies 26 may be used to extend the length or run of runway rails supported thereon. Still further, multiple work stations may be serviced by systems that include a portion of or all of the header assemblies configured as T-shaped header assemblies. Still further, lamppost column assemblies having shorter headers may be used in connection with header assemblies 26, 126 or 226, where the header of such a lamppost assembly may connect with and support a single runway rail.

Figure 10:
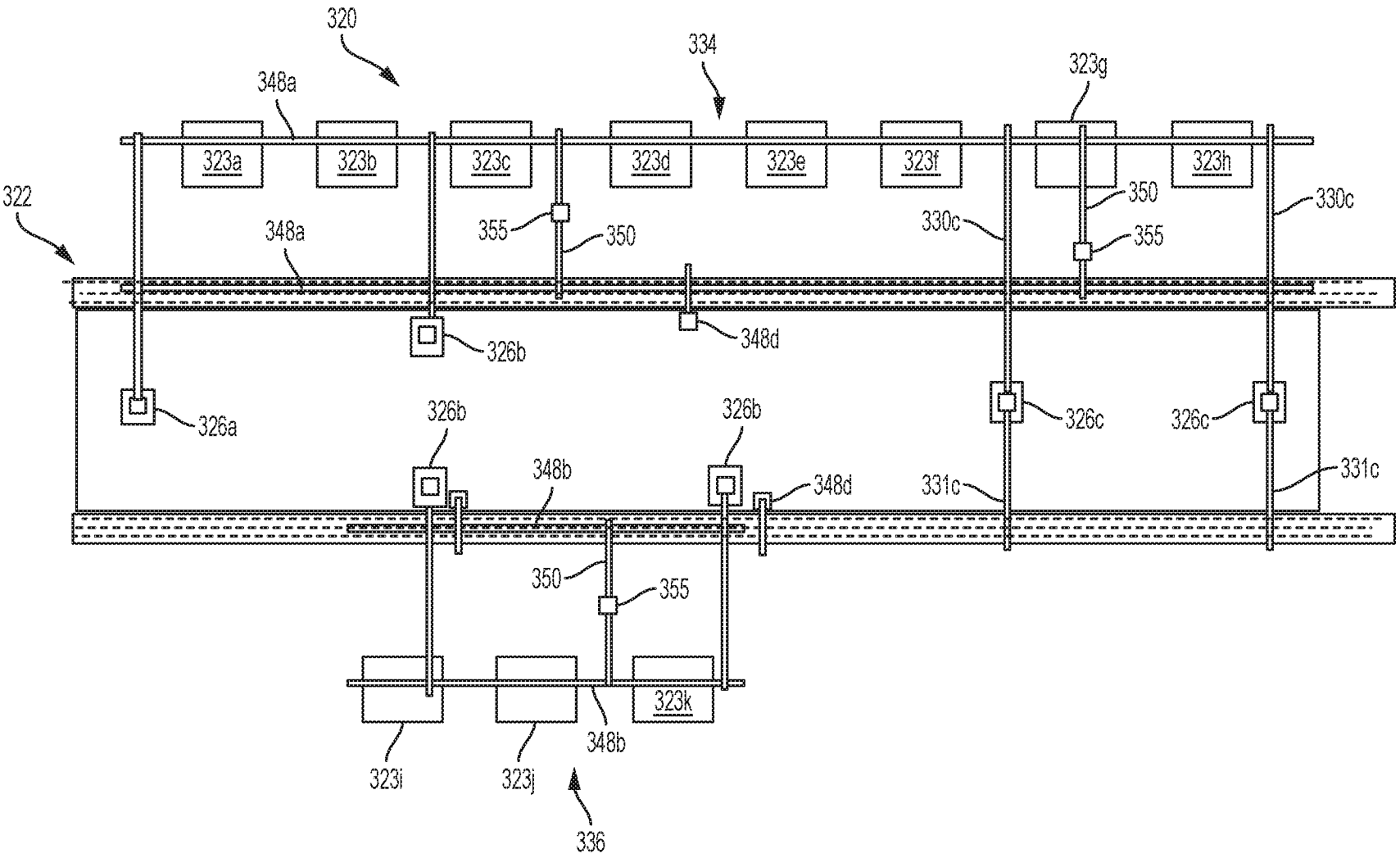
FIG. 10 is an overhead top plan view of a factory work station employing an alternative cantilevered crane system in accordance with the present invention.

An example of an alternative work station 320 is depicted in FIG. 10 with cantilevered crane system 322, which illustrates the utilization of multiple alternative cantilevered header assemblies together. As shown, system includes cantilevered header assemblies 326*a*, 326*b*, 326*c* and 326*d*, where assemblies 326*a* and 326*b* are of the inverted "L" configuration similar to header assemblies 26 of FIGS. 1 to 3. Header assembly 326*c* has a "T" configuration similar to header assembly 126 of FIG. 5, and includes a first horizontal header 330*c* and a second horizontal header 331*c*. A pair of spaced runway rails 348*a* are supported by header assembly 326*a*, a header assembly 326*b* and the first horizontal headers 330*c* of the header assemblies 326*c*. Another pair of spaced runway rails 348*b* are supported by the other two header assemblies 326*b*. Header assemblies 326*d* comprise L-shaped assemblies with short horizontally extending headers for supporting one of the runway rails 348*a*. Bridge rails 350 are supported between each of the pair of runway rails 348*a* and 348*b*, where each bridge rail 350 includes a moveable hoist 355 that slides along the elongate length of the bridge rails 350. As thus configured, work station 320 has elongate sides 334 and 336 that are free of columns or posts, thus facilitating the delivery, storage and/or removal of parts, products or material thereat, such as at the various locations labeled 323*a* to 323*k* in FIG. 10.

Figure 11A:
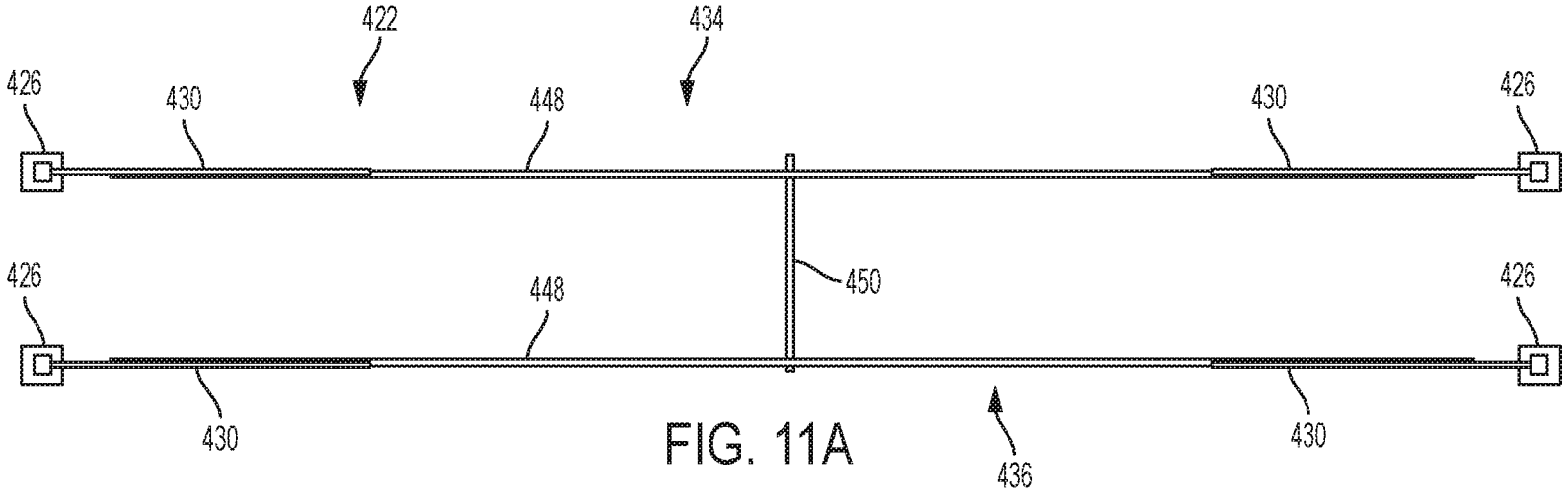
FIG. 11A is an overhead top plan view of another factory work station employing a further alternative cantilevered crane system in accordance with the present invention.
Figure 11B:
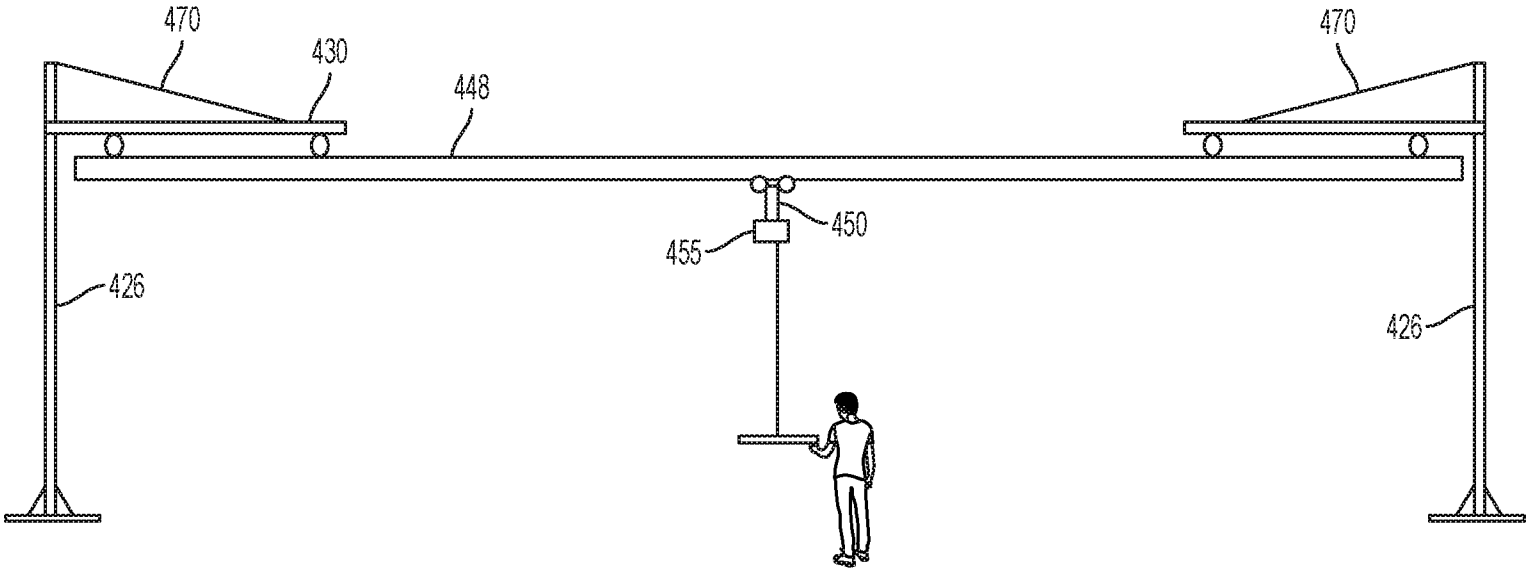
FIG. 11B is a side elevation view of the cantilevered crane system of FIG. 11A.

A further alternative work station 420 is depicted in FIGS. 11A and 11B with cantilevered crane system 422. System 422 comprises four cantilevered header assemblies 426 that each include a horizontal header 430. System 422 further includes runway rails 448, with each runway rail 448 extending between a pair of axially aligned headers 430 of a pair of header assemblies 426. A bridge rail 450 is movably supported between the runway rails 448, with a moveable hoist 455 disposed on the bridge rail 450. As understood from FIG. 11B, each header assembly 426 additionally includes a support or vibration dampening assembly 470, where assemblies 470 are configured in like manner to assembly 170 discussed above. Crane system 422 may be employed to provide a larger span on open sides 434, 436 while enabling smaller sized runway rails 448.

Figure 12:
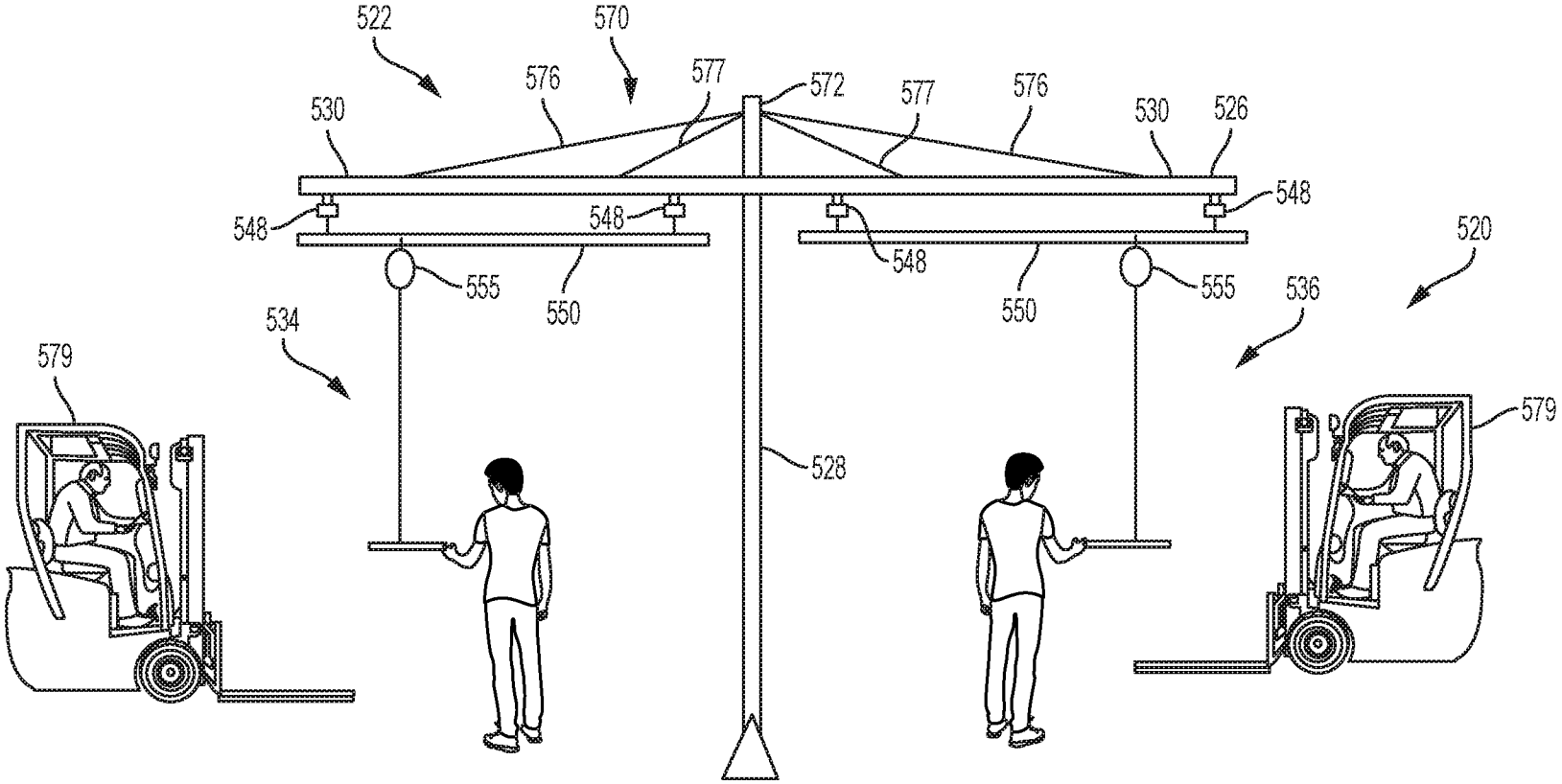
FIG. 12 is a side elevation view of another embodiment of a crane system in accordance with the present invention.

Another work station 520 is depicted in FIG. 12 with cantilevered crane system 522. System 522 comprises two or more cantilevered header assemblies 526 (one shown in FIG. 12) with runway rails 548 supported from headers 530 that extend outwardly from column 528. Bridge rails 550 are in turn supported by the runway rails 548, with movable hoists 555 disposed on the bridge rails 550. System 522 further includes a support or vibration dampening assembly 570, where assembly 570 includes a single vertically oriented upright member 572 extending above headers 530, with rods 576 and 577 extending therefrom. As shown, rods 576 extend outwardly proximate the free end of the headers 530, while rods 577 extend a shorter distance along the headers 530. Thus in the illustrated embodiment, rods 576 extend past an approximate half-way point of the length of the headers 530, while rods 577 extend less than a half-way point of the length of the headers 530. FIG. 12 further depicts the ease of which access to the interior of work station 520 is obtained, such as by way of forklifts entering at open sides 534 and 536, due to the absence of additional columns or posts.

Although the above discussed crane systems are shown and discussed to include at least two cantilevered header assemblies, it should be appreciated that one or more cantilevered header assemblies may be employed with conventional header mounting constructions in a crane system, whereby the cantilevered header assemblies provide openings into a work station, or may be used in environments having limited space that prevent the ability to use a pair of columns to support a header. The cantilevered crane systems of the present invention thus provide work stations having open sides to advantageously enable the delivery into and/or removal of parts, products or material into the work station, such as by way of fork lifts or other such means, including for factories or warehouses or the like.

Further changes and modifications in the specifically described embodiments can be carried out without departing from the principles of the present invention which is intended to be limited only by the scope of the appended claims, as interpreted according to the principles of patent law including the doctrine of equivalents.

The embodiments of the invention in which an exclusive property or privilege is claimed are defined as follows:

1. A workstation having a cantilevered crane system comprising:

a plurality of cantilevered header assemblies, with each said cantilevered header assembly including an upright column and a horizontally oriented header, wherein said header extends from said column with a free end distal from said column;

each said header supporting a pair of runway rails, wherein said runway rails are disposed transversely to each said header with said runway rails being supported by adjacent said headers; and at least one bridge rail movably mounted to said runway rails for movement of said bridge rail transversely to said headers, said bridge rail supporting a moveable hoist for movement of said hoist along a length of said bridge rail;

said cantilevered crane system defining a workstation area bounded by said columns and said headers, with said workstation area including an open side adjacent said free ends of said headers.

2. The workstation of claim 1, wherein said runway rails are disposed perpendicularly to said headers and said bridge rail is disposed perpendicularly to said runway rails.

3. The workstation of claim 1, wherein at least one of said cantilevered header assemblies comprises a T-shaped cantilevered header assembly with said T-shaped cantilevered header assembly including an additional header, and wherein said header and said additional header of said T-shaped cantilevered header assembly extend outwardly from said column of said T-shaped cantilevered header assembly.

4. The workstation of claim 3, wherein at least one of said header and said additional header of said T-shaped cantilevered header assembly supports plant service equipment.

5. The workstation of claim 1, further including at least one vibration dampening assembly mounted to a said cantilevered header assembly whereby said cantilevered header assembly comprises a tensioned cantilevered header assembly, wherein said vibration dampening assembly comprises a vertically oriented post extending above said header of said tensioned cantilevered header assembly and an elongate tension member extending angularly relative to said header from said post toward said free end of said header.

6. The workstation of claim 5, wherein said post extends above said header of said tensioned cantilevered header assembly proximate to where said header connects with said upright column of said tensioned cantilevered header assembly.

7. The workstation of claim 6, wherein said tension member is connected to said header of said tensioned cantilevered header assembly proximate said free end of said header.

8. The workstation of claim 5, further including a tensioner connected to said elongate tension member, said tensioner configured to selectively adjust tension applied to said tension member.

9. The workstation of claim 5, wherein said elongate tension member comprises a rod.

10. The workstation of claim 9, wherein said rod comprises a threaded rod.

11. The workstation of claim 10, further including a tensioner connected with said threaded rod, and wherein said tensioner comprises a turnbuckle.

12. A crane system installed in a building and comprising:

at least one cantilevered header assembly, said cantilevered header assembly including an upright column and a horizontally oriented header, wherein said header extends from said column with a free end distal from said column;

each said header supporting a pair of runway rails, wherein said runway rails are disposed transversely to said header with said runway rails being supported by adjacent said headers; and at least one bridge rail movably mounted to said runway rails for movement of said bridge rail transversely to said headers, wherein said bridge rail is disposed perpendicularly to said runway rails and supports a trolley mounted hoist for movement of said hoist along a length of said bridge rail.

13. The crane system of claim 12, further including a vibration dampening assembly mounted to said cantilevered header assembly, wherein said vibration dampening assembly comprises a vertically oriented post extending above said header of said cantilevered header assembly and an elongate tension member extending angularly relative to said header from said post toward said free end of said header.

14. The crane system of claim 13, wherein said post extends above said header of said cantilevered header assembly proximate to where said header connects with said upright column of said cantilevered header assembly.

15. The crane system of claim 14, further including a tensioner connected to said elongate tension member, said tensioner configured to selectively adjust tension applied to said tension member.

16. The crane system of claim 15, wherein said elongate tension member comprises a threaded rod, and wherein said tensioner comprises a turnbuckle.

17. The crane system of claim 12, wherein said at least one cantilevered header assembly comprises a plurality of cantilevered header assemblies.

18. The crane system of claim 12, wherein said at least one cantilevered header assembly includes an additional header, and wherein said header and said additional header extend outwardly from said column, with said header and said additional header each having a free end distal from said column.

19. The crane system of claim 18, wherein said header and said additional header are aligned with each other along their elongate axial lengths.

* * * * *